US010716183B2

(12) United States Patent
Diana et al.

(10) Patent No.: US 10,716,183 B2
(45) Date of Patent: Jul. 14, 2020

(54) METHOD FOR WIDE-RANGE CCT TUNING THAT FOLLOWS THE BLACK BODY LINE USING TWO INDEPENDENTLY CONTROLLED CURRENT CHANNELS AND THREE CCTS

(71) Applicant: Lumileds LLC, San Jose, CA (US)

(72) Inventors: Frederic S. Diana, San Jose, CA (US); Yifeng Qiu, San Jose, CA (US)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 15/640,549

(22) Filed: Jul. 2, 2017

(65) Prior Publication Data

US 2019/0008013 A1 Jan. 3, 2019

(51) Int. Cl.

| | |
|---|---|
| ***H05B 45/20*** | (2020.01) |
| ***H05B 45/46*** | (2020.01) |
| ***H05B 45/50*** | (2020.01) |
| ***H05B 45/24*** | (2020.01) |

(52) U.S. Cl.

CPC ..... *H05B 45/24* (2020.01); *H05B 45/20* (2020.01); *H05B 45/46* (2020.01); *H05B 45/50* (2020.01)

(58) Field of Classification Search

CPC ..... H05B 33/083; H05B 33/0815; H05B 33/0827; H05B 33/0845; H05B 33/0851; H05B 33/0809; H05B 33/086; H05B 33/0812; H05B 33/0818; H05B 33/0824; H05B 33/0842; H05B 33/0857; H05B 33/0869

USPC .... 315/185 R, 122, 192, 119, 123, 186, 307, 315/308

See application file for complete search history.

(56) References Cited

U.S. PATENT DOCUMENTS

| | | | | |
|---|---|---|---|---|
| 9,791,110 | B2 * | 10/2017 | Hu | H05B 33/08 |
| 2007/0013321 | A1 * | 1/2007 | Ito | H05B 33/0815 315/247 |
| 2008/0116818 | A1 * | 5/2008 | Shteynberg | H05B 33/0815 315/192 |
| 2011/0062872 | A1 * | 3/2011 | Jin | H05B 33/0818 315/122 |
| 2011/0248648 | A1 * | 10/2011 | Liu | G09G 3/3406 315/294 |
| 2012/0081009 | A1 * | 4/2012 | Shteynberg | H05B 33/083 315/122 |
| 2012/0126710 | A1 * | 5/2012 | Lin | H05B 33/0824 315/185 R |
| 2014/0210368 | A1 | 7/2014 | Lee et al. | |
| 2014/0333216 | A1 | 11/2014 | Zhang et al. | |
| 2015/0130361 | A1 * | 5/2015 | Zhang | H05B 33/083 315/186 |
| 2015/0276144 | A1 * | 10/2015 | Tudhope | F21V 23/005 362/294 |

(Continued)

FOREIGN PATENT DOCUMENTS

DE 102012207185 A1 10/2013

*Primary Examiner* — Wei (Victor) Y Chan

(74) *Attorney, Agent, or Firm* — Schwegman Lundberg & Woessner, P.A.

(57) ABSTRACT

An interface currents channeling circuit may be used to convert two current channels of a conventional two-channel driver into three driving currents for the three strings of LEDs. By doing so, the same two channel driver can be used for applications requiring just two LED arrays as well as three LED arrays.

17 Claims, 5 Drawing Sheets

(56) References Cited

U.S. PATENT DOCUMENTS

| | | | | |
|---|---|---|---|---|
| 2015/0312983 | A1* | 10/2015 | Hu | F21V 29/503 315/186 |
| 2015/0351187 | A1* | 12/2015 | McBryde | H05B 33/0803 315/185 R |
| 2017/0019969 | A1* | 1/2017 | O'Neil | H05B 33/083 |
| 2017/0354008 | A1* | 12/2017 | Eum | H02M 1/08 |

* cited by examiner

METHOD FOR WIDE-RANGE CCT TUNING THAT FOLLOWS THE BLACK BODY LINE USING TWO INDEPENDENTLY CONTROLLED CURRENT CHANNELS AND THREE CCTS

BACKGROUND

Tunable white lighting is one of the biggest trends in commercial and home lighting. A tunable-white luminaire is usually able to change its color and light output level along two independent axes.

SUMMARY

An interface currents channeling circuit may be used to convert two current channels of a conventional two-channel driver into three driving currents for the three LED arrays. By doing so, the same two channel driver may be used for applications requiring just two LED arrays as well as three LED arrays.

BRIEF DESCRIPTION OF THE DRAWINGS

A more detailed understanding may be had from the following description, given by way of example in conjunction with the accompanying drawings wherein.

DETAILED DESCRIPTION

In the following description, numerous specific details are set forth, such as particular structures, components, materials, dimensions, processing steps, and techniques, in order to provide a thorough understanding of the present embodiments. However, it will be appreciated by one of ordinary skill of the art that the embodiments may be practiced without these specific details. In other instances, well-known structures or processing steps have not been described in detail in order to avoid obscuring the embodiments. It will be understood that when an element such as a layer, region, or substrate is referred to as being "on" or "over" another element, it can be directly on the other element or intervening elements may also be present. In contrast, when an element is referred to as being "directly on" or "directly" over another element, there are no intervening elements present. It will also be understood that when an element is referred to as being "beneath," "below," or "under" another element, it can be directly beneath or under the other element, or intervening elements may be present. In contrast, when an element is referred to as being "directly beneath" or "directly under" another element, there are no intervening elements present.

In the interest of not obscuring the presentation of embodiments in the following detailed description, some processing steps or operations that are known in the art may have been combined together for presentation and for illustration purposes and in some instances may have not been described in detail. In other instances, some processing steps or operations that are known in the art may not be described at all. It should be understood that the following description is rather focused on the distinctive features or elements of various embodiments described herein.

Figure 1:
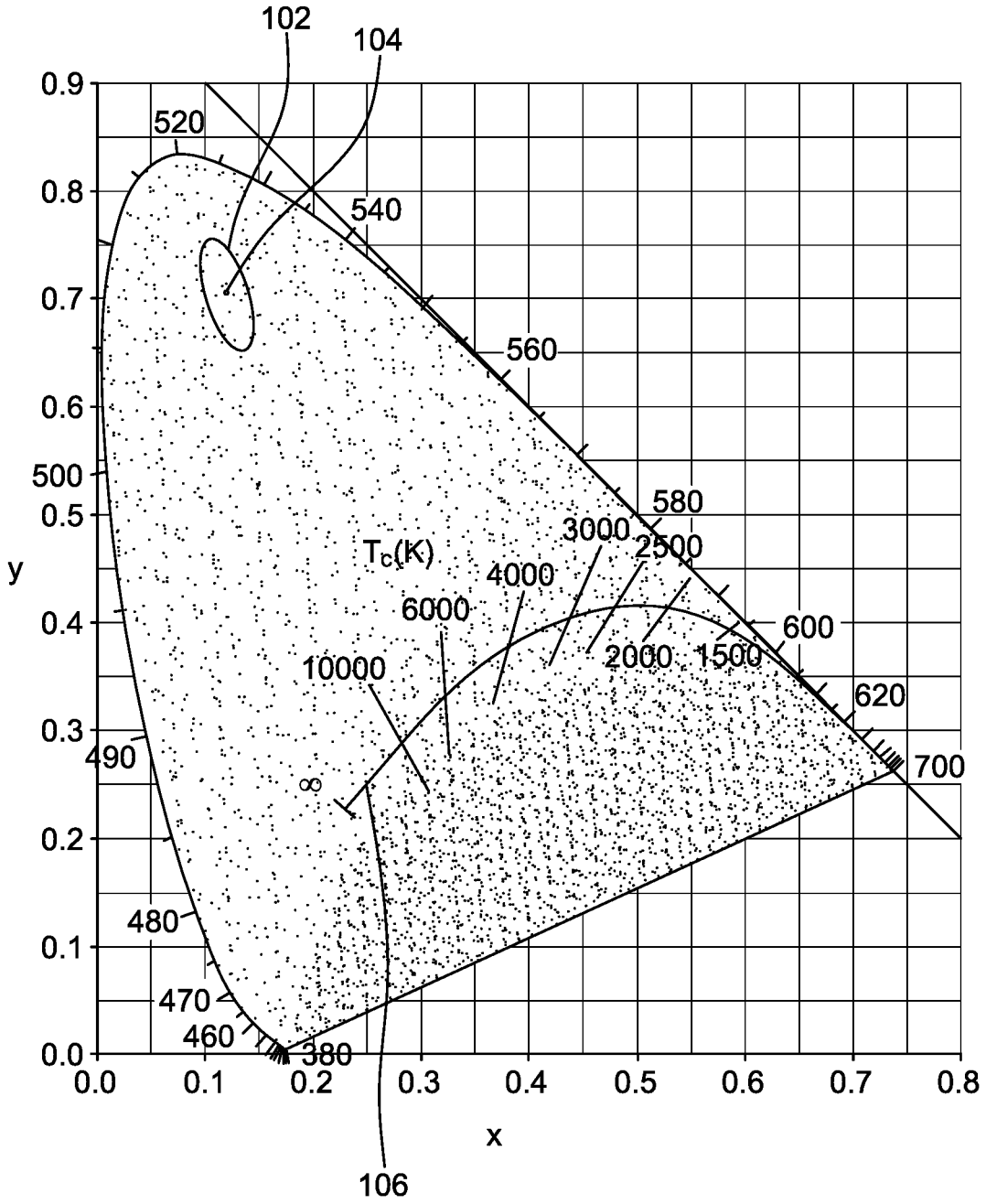
FIG. 1 is a chromaticity diagram representing a color space.

Referring to FIG. 1, a chromaticity diagram representing a color space is shown. A color space is a three-dimensional space; that is, a color is specified by a set of three numbers that specify the color and brightness of a particular homogeneous visual stimulus. The three numbers may be the International Commission on Illumination (CIE) coordinates X, Y, and Z, or other values such as hue, colorfulness, and luminance. Based on the fact that the human eye has three different types of color sensitive cones, the response of the eye is best described in terms of these three "tristimulus values."

A chromaticity diagram is a color projected into a two-dimensional space that ignores brightness. For example, the standard CIE XYZ color space projects directly to the corresponding chromaticity space specified by the two chromaticity coordinates known as x and y, as shown in FIG. 1.

Chromaticity is an objective specification of the quality of a color regardless of its luminance. Chromaticity consists of two independent parameters, often specified as hue and colorfulness, where the latter is alternatively called saturation, chroma, intensity, or excitation purity. The chromaticity diagram may include all the colors perceivable by the human eye. The chromaticity diagram may provide high precision because the parameters are based on the spectral power distribution (SPD) of the light emitted from a colored object and are factored by sensitivity curves which have been measured for the human eye. Any color may be expressed precisely in terms of the two color coordinates x and y.

All colors within a certain region, known as a MacAdam ellipse (MAE) 102, may be indistinguishable to the average human eye from the color at the center 104 of the ellipse. The chromaticity diagram may have multiple MAEs. Standard Deviation Color Matching in LED lighting uses deviations relative to MAEs to describe color precision of a light source.

The chromaticity diagram includes the Planckian locus, or the black body line (BBL) 106. The BBL 106 is the path or locus that the color of an incandescent black body would take in a particular chromaticity space as the blackbody temperature changes. It goes from deep red at low temperatures through orange, yellowish white, white, and finally bluish white at very high temperatures. Generally speaking, human eyes prefer white color points not too far away from the BBL 106. Color points above the black body line would appear too green while those below would appear too pink.

One method of creating white light using light emitting diodes (LEDs) may be to additively mix red, green and blue colored lights. However, this method may require precise calculation of mixing ratios so that the resulting color point is on or close to the BBL 106. Another method may be to mix two or more phosphor converted white LEDs of different correlated color temperatures (CCTs). This method is described in additional detail below.

To create a tunable white light engine, LEDs having two different CCTs on each end of a desired tuning range may be used. For example, a first LED may have a CCT of 2700K, which is a warm white, and a second LED may have a color temperature of 4000K, which is a neutral white. White colors having a temperature between 2700K and 4000K may be obtained by simply varying the mixing ratio of power provided to the first LED through a first channel of a driver and power provided to the second LED through a second channel of the driver.

Figure 2:
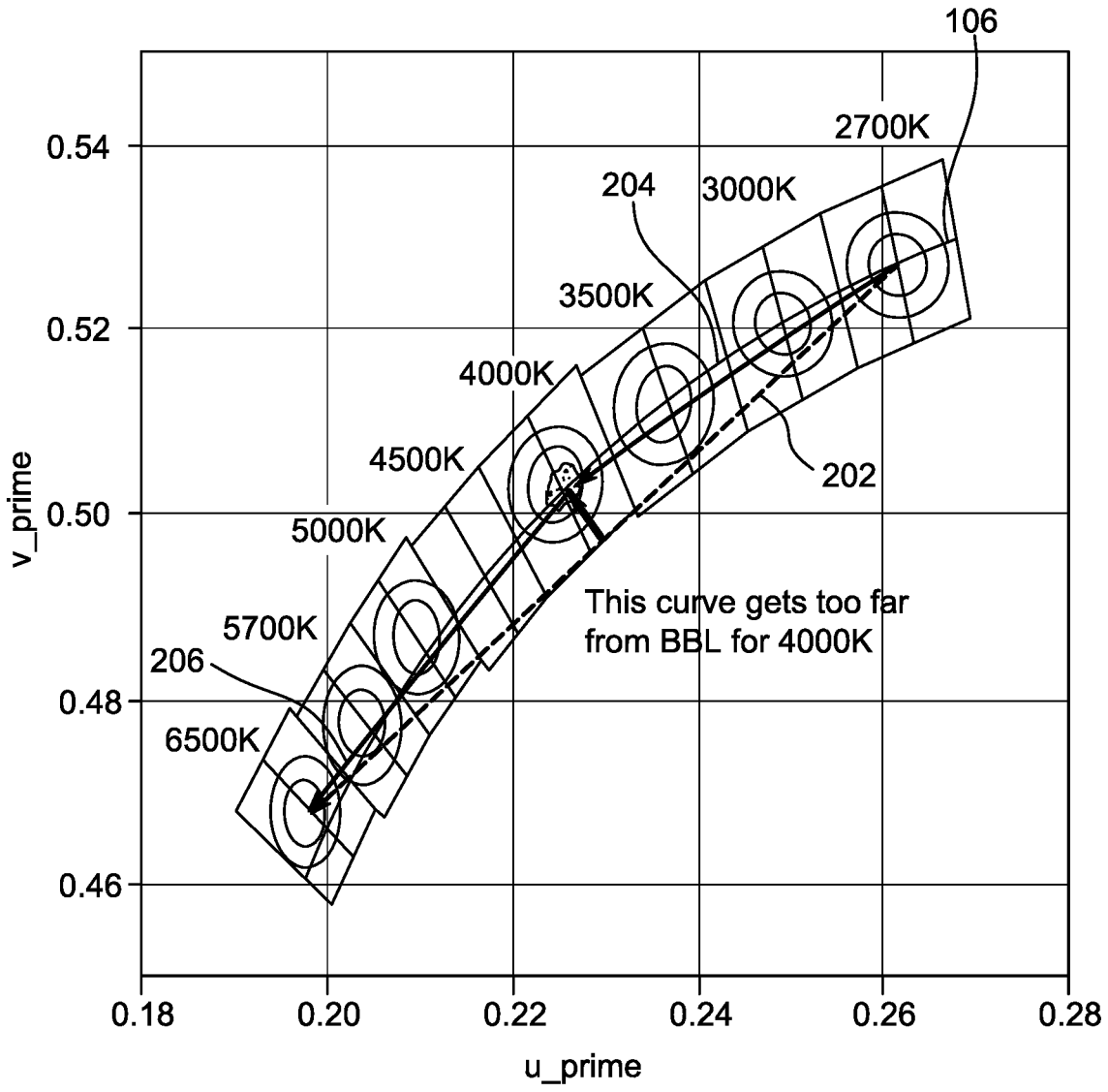
FIG. 2 is a diagram illustrating different correlated color temperatures (CCTs) and their relationship to a black body line (BBL) on the chromaticity diagram.

Referring now to FIG. 2, a diagram illustrating different CCTs and their relationship to the BBL 106 is shown. When plotted in the chromaticity diagram, the achievable color points of mixing two LEDs with different CCTs may form a first straight line 202. Assuming the color points of 2700K and 4000K are exactly on the BBL 106, the color points in between these two CCTs would be below the BBL 106. This may not be a problem, as the maximum distance of points on this line from the BBL 106 may be relatively small.

However, in practice, it may be desirable to offer a wider tuning range of color temperatures between, for example, 2700K and 6500K, which may be cool white or day light. If only 2700K LEDs and 6500K LEDs are used in the mixing, the first straight line 202 between the two colors may be far below the BBL 106. As shown in FIG. 2, the color point at 4000K may be very far away from the BBL 106.

To remedy this, a third channel of neutral white LEDs (4000K) may be added between the two LEDs and a 2-step tuning process may be performed. For example, a first step line 204 may be between 2700K and 4000K and a second step line 206 may be between 4000K and 6500K. This may provide 3 step MAE BBL color temperature tunability over a wide range of CCTs. A first LED array having a warm white (WW) CCT, a second LED array having a neutral white (NW) CCT, and a third LED array having a cool white (CW) CCT and a two-step tuning process may be used to achieve three-step MAE BBL CCT tunability over a wide range of CCTs.

Figure 3:
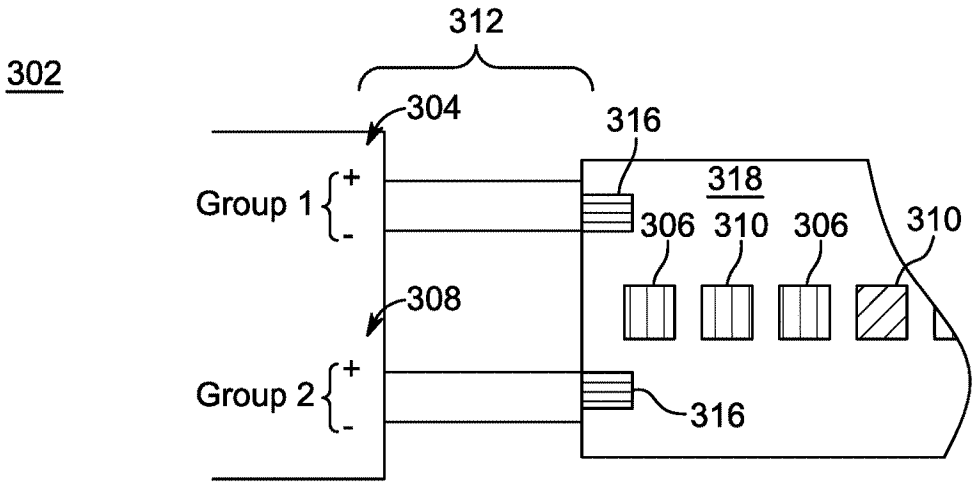
FIG. 3 is a block diagram illustrating hardware used in a tunable white light engine having a corresponding number of light emitting diode (LED) arrays and driver channels.

Referring now to FIG. 3, a block diagram illustrating hardware used in a tunable white light engine having a corresponding number of LED arrays and driver channels is shown. As described above, a two channel driver 302 may be used to power two LED arrays having CCTs at the ends of a desired tuning range. The two channel driver 302 may be a conventional LED driver known in the art. The two LED arrays may be mounted on an LED board 318. A first channel 304 of the two channel driver 302 may power a first LED array 306 of a first CCT and a second channel 308 of the two channel driver 302 may power a second LED array 310 of a second CCT. The two channel driver 302 may provide two driving currents to the LED board 318 over one or more electrical connections 312, such as wires or direct board to board connections. The one or more electrical connections 312 may be connected to one or more solder points 316.

A three-channel driver may be used to control the three LED arrays in a similar manner. However, a three-channel driver may be more complex and expensive than a conventional two channel driver. It may be desirable to multiply the output of a driver to power a greater number of LED arrays than channels, such that there is more than a 1:1 ratio of driver channels to LED arrays.

Figure 4:
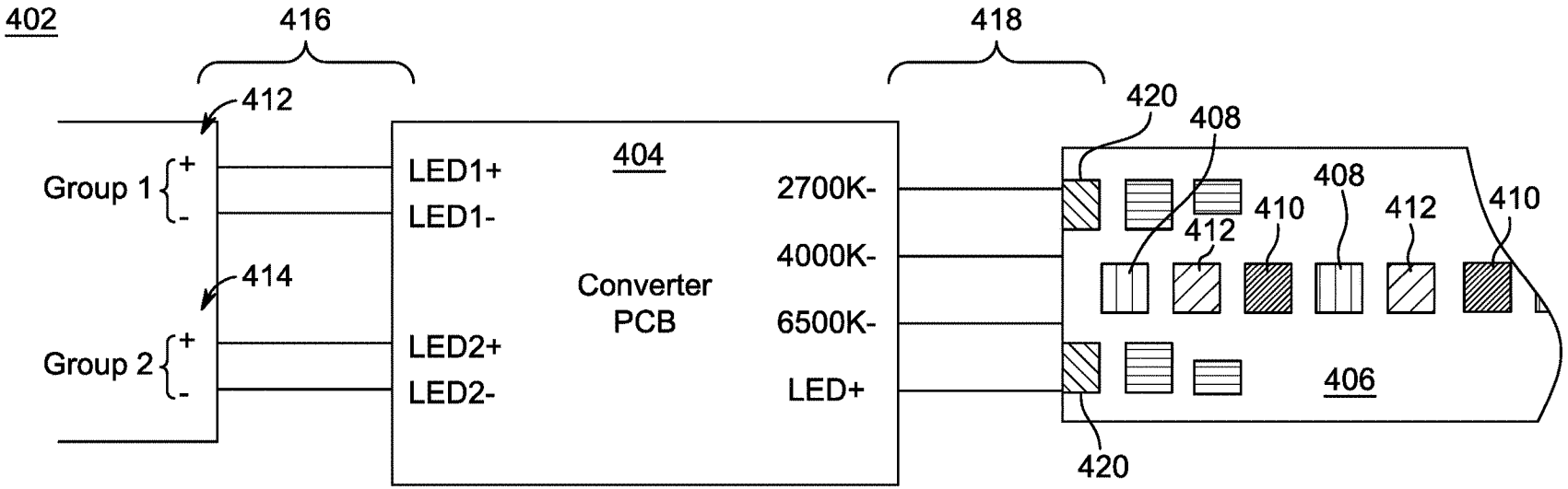
FIG. 4 is a block diagram illustrating hardware used in tunable white light engine having a greater number of LED arrays than driver channels.

Referring now to FIG. 4, a block diagram illustrating hardware used in tunable white light engine having a greater number of LED arrays than driver channels is shown. An interface currents channeling circuit may be used to convert two current channels of a two channel driver 402 into three driving channels in order to achieve 2-piece linear near BBL 106 color temperature tunability.

In an embodiment, the interface currents channeling circuit may be mounted on a converter printed circuit board (PCB) 404 between the two channel driver 402 and a LED board 406. The two channel driver 302 may be a conventional LED driver known in the art. The interface currents channeling circuit may allow the two channel driver 402 to be used for applications requiring two LED arrays as well as applications with three LED arrays. Because the same two channel driver 402 may be used in both cases, circuit complexity, size, and expense may be reduced.

It should be noted that although FIG. 3 shows an interface channeling circuit that may be used to power three LED arrays using a two-channel driver, the principles described below may be applied to any arrangement in which a driver is used to power a number of LED arrays that is greater than a number of output channels. In addition, although the follow description relates to the tunability of LED arrays having different CCTs, a person skilled in the art would understand that the embodiments described herein may apply to any desired tunable range, such as color ranges, infrared (IR) ranges, and ultraviolet (UV) ranges.

As described in more detail below, the interface currents channeling circuit mounted on the converter PCB 404 may enable the two channel driver 402 to power two LED arrays at the ends of a desired tunable range as well as an additional LED array in approximately the middle of the desired tunable range. A first LED array 408 having a first CCT, a second LED array 410 having a second CCT, and a third LED array 412 having a third CCT may be mounted on the LED board 318. A first channel 412 of the two channel driver 402 and a second channel 414 may be connected to the PCB 404 by a first set of connections 416, such as wires or direct board to board connections. The first channel 412 and the second channel 414 may each have a positive and a negative output.

The converter PCB 404 may provide three driving currents to the LED board 406 over a second set of electrical connections 418, such as wires or direct board to board connections. The second set of electrical connections 418 may be connected to one or more solder points 420 on the LED board 406. The second set of electrical connections 418 may include three separate negative outputs for the first LED array 408, the second LED array 410, and the third LED array 412. A LED+ output from the converter PCB 404 may be connected to a positive output of the two channel driver 402. The LED+ output may be connected to anode ends of the first LED array 408, the second LED array 410, and the third LED array 412.

The mathematical relationship between the inputs and outputs of the interface currents channeling circuit are described herein. In the following equations, a first input current may be I1 and a second input current may be I2. The output currents may be $I_{WW}$ for warm white (WW) LEDs, $I_{NW}$ for neutral white (NW) LEDs, and $I_{CW}$ for cool white (CW) LEDs. The relationship may be defined as follows:

$$\text{If } I1>I2 \text{ then } I_{WW}=I1-I2, I_{NW}=2\times I2, I_{CW}=0 \qquad \text{Equation (1)}$$

$$\text{Else } I_{WW}=0, I_{NW}=2\times I1, I_{CW}=I2-I1 \qquad \text{Equation (2)}$$

In the case of I1>I2, the WW channel may receive a current equal to the difference between I1 and I2, while the NW channel may receive twice the amount of current of I2. The sum of $I_{WW}$ and $I_{NW}$ may still be I1+I2. It should be noted that the actual sum may be slightly less than I1+I2 as part of the total current is used to power the interface currents channeling circuit.

If the current in I1 is 0 and I1 corresponds to the WW LEDs, all the current in I2 will go to the CW LEDs and no current will go to the WW LEDs or the NW LEDs. Likewise, if the current in I2 is 0 and I2 corresponds to the CW LEDs, all the current in I1 will go to the WW LEDs and no current will go to the CW LEDs or the NW LEDs.

Figure 5:
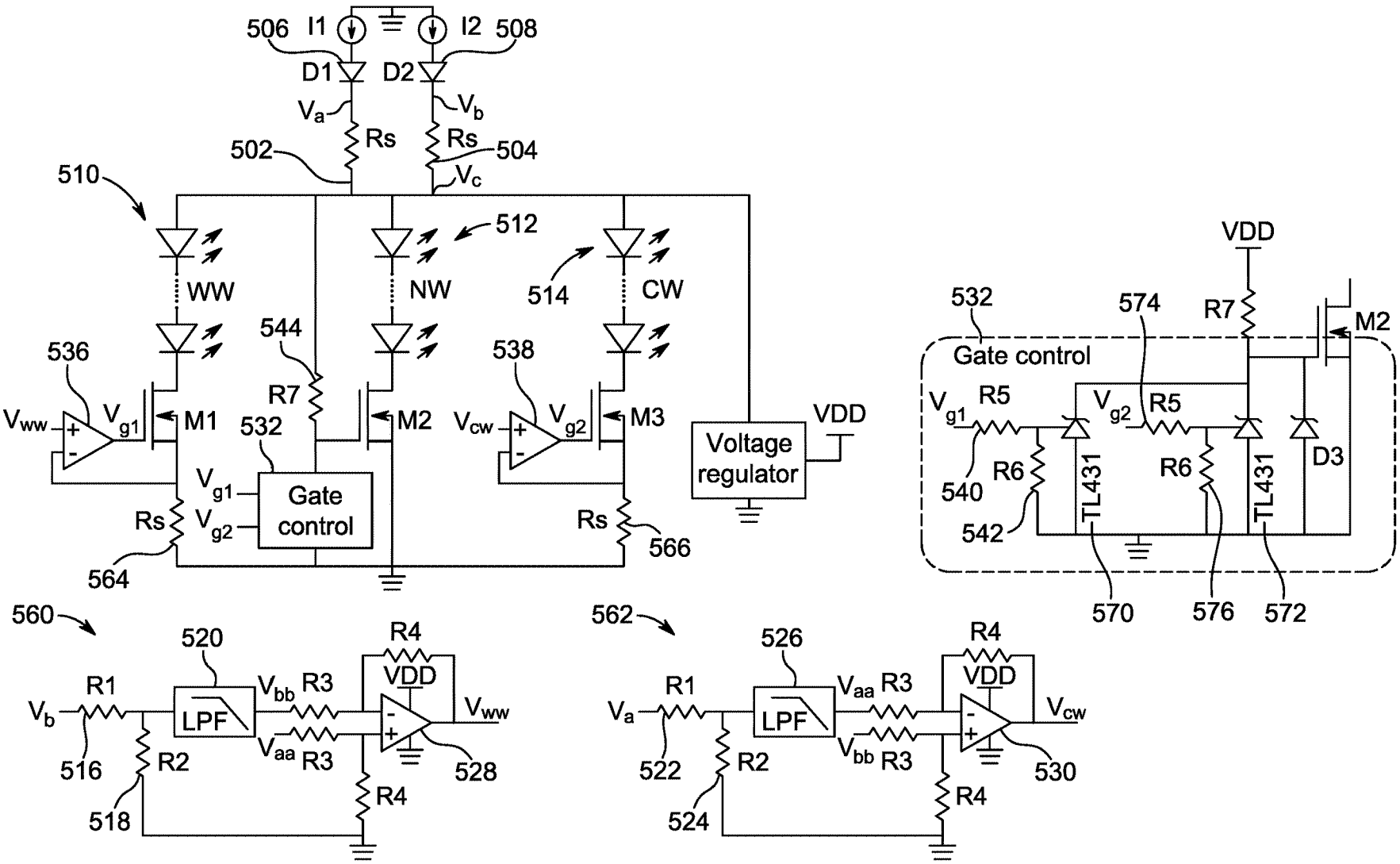
FIG. 5 is a circuit diagram of an interface currents channeling circuit.

Referring now to FIG. 5, a circuit diagram of the interface currents channeling circuit is shown. The interface currents channeling circuit makes use of various analog techniques, such as voltage sensing, low-pass filter and analog signal subtraction. All voltages shown in the diagram refer to the ground. The converter PCB may control currents flowing through WW LEDs and CW LEDs using voltage controlled current sources. In addition, the converter PCB may perform only on/off control on current flowing through NW LEDs. The WW LEDs and the CW LEDs may have CCTs that are on the ends of a desired tunable range. The NW LEDs may have a CCT that is located approximately in the middle of the desired tunable range.

The first input current I1 may be connected to a first sense resistor (Rs) 502. The second input current I2 may be connected to a second Rs 504. The first Rs 502 and the second Rs 504 may have the same resistance value. A first diode D1 506 may prevent the first input current I1 from injecting into the second input current I2. A second diode D2 508 may prevent the second input current I2 from injecting into the first input current I1. The first Rs 502 and the second Rs 504 may share one common terminal $V_c$, which may be connected to the anodes of a first LED string 510 that includes WW LEDs, a second LED string 512 that includes NW LEDs, and a third LED string 514 that includes CW LEDs. The voltages at $V_a$ and Vb are representative of the currents flowing through the first Rs 502 and the second Rs 504 with a common-mode component, which is the voltage at $V_c$.

As shown in a first computational circuit 560, the voltage at $V_b$ may be attenuated by a resistive divider that includes a first resistor (R1) 516 and a second resistor (R2) 518. The resulting signal may be sent through a first low-pass filter (LPF) 520 to generate $V_{bb}$ in a low voltage domain. $V_{bb}$ may be defined as:

$$V_{bb}=\mathrm{LPF}(V_b\times\alpha), \quad \text{Equation (3)}$$

where α is an attenuation factor, which may be defined as:

$$\alpha=\frac{R2}{(R1+R2)}. \quad \text{Equation (4)}$$

As shown in a second computational circuit 562, the voltage at $V_a$ may be attenuated by a resistive divider that includes a first resistor (R1) 522 and a second resistor (R2) 524. In an embodiment, the first resistor (R1) 522 may be the same value as the first resistor (R1) 516 and the second resistor (R2) may be the same value as the second resistor (R2) 518. The resulting signal may be sent through a second LPF 526 to generate $V_{aa}$ in a low voltage domain. In an embodiment, the second LPF 526 may perform the same operations as the first LPF 520. $V_{aa}$ may be defined as:

$$V_{aa}=\mathrm{LPF}(V_a\times\alpha), \quad \text{Equation (5)}$$

where α is the attenuation factor defined above in Equation (4).

$V_{bb}$ may be fed to a first operational amplifier (opamp) 528 that is configured to perform subtraction between $V_{bb}$ and $V_{aa}$. The outputs of the first opamp 528 may be $V_{WW}$. $V_{WW}$ may be defined as:

$$V_{WW}=(V_{aa}-V_{bb})\times\beta, \quad \text{Equation (6)}$$

$$\text{where } \beta=R4/R3. \quad \text{Equation (7)}$$

$V_{WW}$ may also be defined as:

$$V_{WW}=(I1-I2)\times R_S\times\alpha\times\beta. \quad \text{Equation (8)}$$

The current $I_{WW}$ may therefore be defined as:

$$I_{WW}=V_{WW}/R=(I1-I2)\times\alpha\times\beta\times R_S/R \quad \text{Equation (9)}$$

When α*ß/R equals the value of 1/Rs, the current $I_{WW}$ will equal I1−I2.

$V_{aa}$ may be fed to a second opamp 530 that is configured to perform subtraction between $V_{aa}$ and $V_{bb}$. The output of the second opamp 530 may be $V_{CW}$. $V_{CW}$ may be defined as:

$$V_{CW}=(V_{bb}-V_{aa})\times\beta, \quad \text{Equation (10)}$$

where β is defined above in Equation (7). In an embodiment, R3 and R4 may have the same values in the first computational circuit 560 and the second computational circuit 562.

$V_{CW}$ may also be defined as:

$$V_{CW}=(I2-I1)\times R_S\times\alpha\times\beta. \quad \text{Equation (11)}$$

The current $I_{WW}$ may therefore be defined as:

$$I_{CW}=V_{CW}/R=(I2-I1)\times\alpha\times\beta\times R_S/R \quad \text{Equation (12)}$$

When α*ß/R equals the value of 1/Rs, the current $I_{CW}$ will equal I2−I1.

The $V_{WW}$ may be fed to a voltage controlled current source, which may be implemented with a first amplifier (amp) 536. The first amp 536 may output a voltage $V_{g1}$. The voltage $V_{g1}$ may be input to a first transistor M1 that is used to provide a driving current for the first LED string 510. The first transistor M1 may be a conventional metal oxide semiconductor field effect transistor (MOSFET). The first transistor M1 may be an n-channel MOSFET.

The first amp 536 may regulate the voltage $V_{g1}$ in a closed loop such that current flowing through the first transistor M1 is equal to $V_{WW}$/Rs. The inputs to the first amp 536 may be very close to each other in a closed loop regulation. The first amp 306 may compare the value of $V_{WW}$ to the sensed voltage across Rs 564 at the source of the first transistor M1. The Rs 564 may have the same resistance value as the first Rs 502 and/or the second Rs 504. If the sensed voltage is lower than $V_{WW}$, the first amp 306 may raise $V_{g1}$ to increase the current in the first transistor M1 until the sensed voltage is approximately equal to $V_{WW}$. Likewise, if the sensed voltage is higher than $V_{WW}$, the first amp 306 may reduce $V_{g1}$, which may reduce the current in the first transistor M1.

The $V_{CW}$ may be fed to the voltage controlled current source, which may be implemented with a second amp 538. The second amp 538 may output a voltage $V_{g2}$. The voltage $V_{g2}$ may be input to a third transistor M3 that is used to provide a driving current for the third LED string 514. The third transistor M3 may be a conventional metal oxide semiconductor field effect transistor (MOSFET). The third transistor M3 may be an n-channel MOSFET.

The second amp 538 may regulate the voltage $V_{g2}$ in a closed loop such that current flowing through the third transistor M3 is equal to $V_{CW}$/Rs. The inputs to the second amp 538 may be very close to each other in a closed loop regulation. The second amp 538 may compare the value of $V_{CW}$ to the sensed voltage across Rs 566 at the source of the third transistor M3. The Rs 566 may have the same resistance value as the first Rs 502 and/or the second Rs 504. If the sensed voltage is lower than $V_{CW}$, the second amp 538 may raise $V_{g2}$ to increase the current in the third transistor M3 until the sensed voltage is approximate equal to $V_{CW}$.

Likewise, if the sensed voltage is higher than $V_{CW}$, the second amp 538 may reduce $V_{g2}$, which may reduce the current in the third transistor M3.

The output of the first amp 536 and the output of the second amp 538 may be clamped to zero when the difference between its inputs is negative.

A second transistor M2 may control power to the second LED string 512. The second transistor M2 may be a conventional metal oxide semiconductor field effect transistor (MOSFET). The second transistor M2 may be an n-channel MOSFET. The second transistor M2 may only be switched on when both the first input current I1 and the second input current I2 are in regulation. The second transistor M2 may have a pull up resistor (R7) 544 tied to Vc. The pull up resistor (R7) 544 may be tied to the node Vc because, at startup, the low voltage supply VDD may not be available. As a result, the first transistor M1 and the third transistor M3 would be in an off state. If the second transistor M2, which provides a driving current for the second LED string 512, is also off, the whole circuit would appear as open-circuit to the current sources. This may trigger open-circuit protection and lead to a non-startup condition. By tying the gate of M2 to the node Vc, it may provide a current path available at startup.

The current produced by the voltage controlled current sources for the first LED string 510 and the third LED string 514 may be slightly larger than the absolute value of (I1−I2). This may ensure that the second LED string 512 is off when either I1 or I2 carries zero current. In other words, only one string of LEDs at either endpoint of the desired tuning range may be on at a time.

The AND logic of the switching transistor may be realized by the gate control block 532. The gate control block 532 makes use of the fact that the output of the first amp 536 ($V_{g1}$) and the output of the second amp 538 ($V_{g2}$) in a voltage controlled current source may swing to its supply rail (VDD) if it is unable to maintain regulation. The VDD may be chosen in such a way that the voltages $V_{g1}$ and $V_{g2}$ are significantly lower than VDD when the first amp 536 and the second amp 538 are in regulation under all operating conditions.

The $V_{g1}$ may be attenuated by resistive dividers that include a first resistor (R5) 540 and a second resistor (R6) 542, and then fed to a REF input of a first shunt regulator 570. The $V_{g2}$ may be attenuated by resistive dividers that include a first resistor (R5) 574 and a second resistor (R6) 576, and then fed to a REF input of a second shunt regulator 572. In an embodiment, the first resistor (R5) 540 and the second resistor (R6) 542 may be the same value as the first resistor (R5) 574 and the second resistor (R6) 576 $V_{g2}$. The first shunt regulator 570 and the second shunt regulator 572 may have an internal reference voltage of 2.5V. When the voltage applied at their REF nodes is higher than 2.5V, the first shunt regulator 570 and the second shunt regulator 572 may sink a large current. When the voltage applied at their REF nodes is lower than 2.5V, the first shunt regulator 570 and the second shunt regulator 572 may sink a very small quiescent current.

The large sinking current may pull the gate voltage of the second transistor M2 down to a level below its threshold, which may switch off the second transistor M2. The first shunt regulator 570 and the second shunt regulator 572 may not be able to pull their cathodes more than the $V_f$ of a diode below their REF nodes. Accordingly, the second transistor M2 may have a threshold voltage that is higher than 2V. Alternatively, a shunt regulator with a lower internal reference voltage, such as 1.5V, may be used.

If $V_{g1}$ and $V_{g2}$ would be maximum around 3V, the VDD may be set to be 5V and the attenuation factor $\alpha$ may be set to 0.6. When the first amp 536 and the second amp 538 are in regulation, the voltage appearing at the REF node of the shunt regulator would be a maximum of 1.8V, the shunt regulator may draw a minimum current and the gate of the second transistor M2 may be pulled high towards the VDD. If either the first amp 536 or the second amp 538 is out of regulation, the shunt regulator may switch off the NMOS.

It should be noted that well-known structures shown in FIG. 5, including one or more resistors, diodes, and capacitors, and processing steps have not been described in detail in order to avoid obscuring the embodiments described herein.

Figure 6:
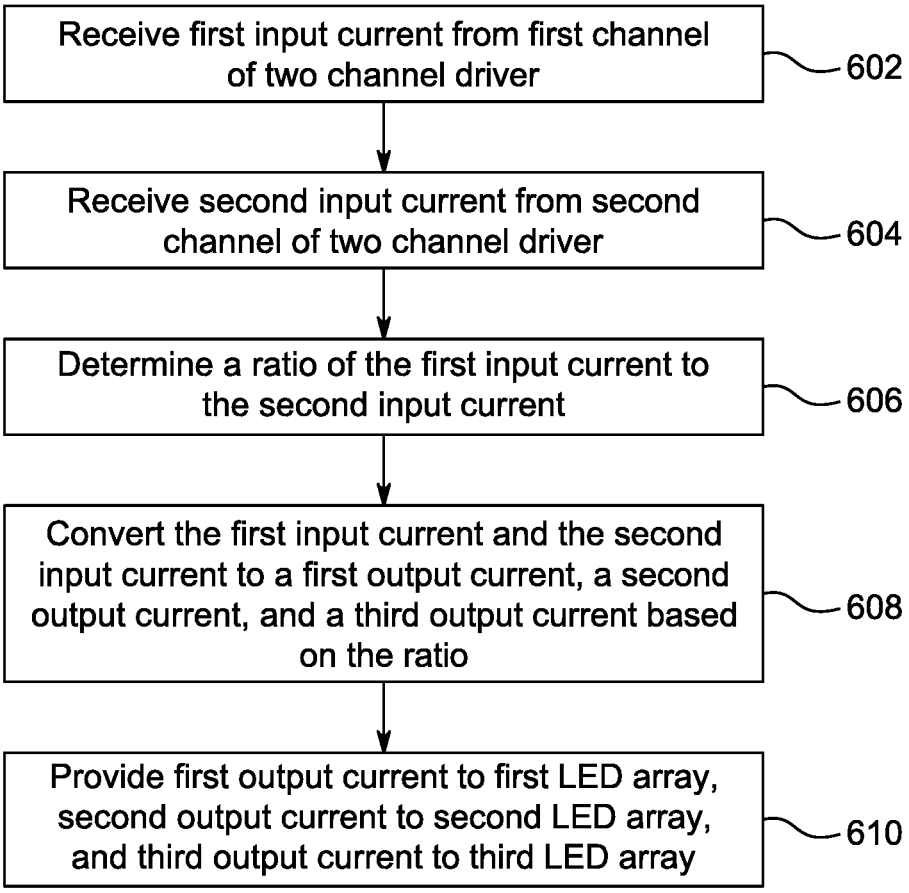
FIG. 6 is a flowchart illustrating a method for providing two-step linear CCT tunability in one or more LED arrays.

Referring now to FIG. 6, a flowchart illustrating a method for providing two-step linear CCT tunability in one or more LED arrays is shown. In step 602, the first input current I1 may be received from the first channel 412 of the two channel LED driver 402. In step 604, a second input current I2 may be received from the second channel 414 of the two channel LED driver 402. In step 606, a ratio of the first input current I1 to the second input current I2 may be determined. In step 608, the first input current I1 and the second input current I2 may be converted to a first output current, a second output current, and a third output current based on the ratio. In step 610, the first output current may be provided to a first LED array 510 having a CCT at approximately an end of a desired CCT range, the second output current may be provided to a second LED array 516 having a CCT at approximately an opposite end of the desired CCT range, and the third output current may be provided to a third LED array 514 having a CCT in approximately a middle of a desired CCT range.

The method shown in FIG. 6 may be performed by the interface currents channeling circuit. The interface currents channeling circuit may include a first sense resistor 502 to sense a first input voltage from a first input current I2 from a first channel 412 of a two channel LED driver 402. A second sense resistor 504 may sense a second input voltage of a second input current I2 from a second channel 414 of the two channel LED driver 402. The first sense resistor 502 and the second sense resistor 504 are tied to a common node $V_c$. A first computational circuit 560 may be configured to subtract the second input voltage from the first input voltage to generate a first output voltage to power a first LED array 510 having a CCT at approximately an end of a desired CCT range. A second computational circuit 562 may be configured to subtract the first input voltage from the second input voltage to generate a second output voltage to power a second LED array 516 having a CCT at approximately an opposite end of the desired CCT range. A gate control block 532 may be configured to generate a third output voltage to power a third LED array 514 having a CCT in approximately a middle of a desired CCT range if the first input current I1 and the second input current I2 are both in regulation.

Although features and elements are described above in particular combinations, one of ordinary skill in the art will appreciate that each feature or element can be used alone or in any combination with the other features and elements. In addition, the methods described herein may be implemented in a computer program, software, or firmware incorporated in a computer-readable medium for execution by a computer or processor. Examples of computer-readable media include electronic signals (transmitted over wired or wireless connections) and computer-readable storage media. Examples of computer-readable storage media include, but are not limited to, a read only memory (ROM), a random access memory (RAM), a register, cache memory, semiconductor memory devices, magnetic media such as internal hard disks and removable disks, magneto-optical media, and optical media such as CD-ROM disks, and digital versatile disks (DVDs).

What is claimed is:

1. A circuit comprising:

a first input terminal configured to receive a first current having a first current level from a first current channel;

a second input terminal configured to receive a second current having a second current level from a second current channel;

a first current generator configured to provide a first drive current having a level equal to the first current level minus the second current level on a first condition that the first current level is greater than the second current level and equal to zero otherwise;

a second current generator configured to provide a second drive current having a level equal to two times the second current level on a second condition that the first current level is greater than the second current level and equal to two times the first current level otherwise; and a controller configured to provide a third drive current having a level equal to zero on a third condition that the first current level is greater than the second current level and equal to the second current level minus the first current level otherwise.

2. A light-emitting diode (LED) lighting system comprising:

an LED array configured to emit light having a first correlated color temperature (CCT) at a first end of a first range;

a second LED array configured to emit light having a second CCT at a second end of the first range;

a third LED array configured to emit light having a third CCT in a range between the first CCT and the second CCT;

a two-channel LED driver having two output terminals configured to provide a separate driving current at each of the two output terminals; and a converter circuit having two input terminals, each of the two input terminals electrically coupled to a respective one of the two output terminals of the two-channel LED driver, and three output terminals, each of the three output terminals electrically coupled to a respective one of the first, second, and third LED arrays to provide a separate drive current to each of the first, second, and third LED arrays via respective first, second, and third drive channels, the converter circuit including:

a first computational circuit electrically coupled to receive a first voltage based on a first driving current of the two channel LED driver and configured to provide a first output voltage having a level equal to a level of the second input voltage minus a level of the first input voltage;

a second computational circuit electrically coupled to receive a second input voltage based on a second driving current of the two channel LED driver and configured to provide a second output voltage having a level equal to the level of the first input voltage minus the level of the second input voltage;

a first current generator configured to generate a first drive current having a level based on the level of the first output voltage;

a second current generator configured to generate a second drive current having a level based on the level of the second output voltage; and a control circuit configured to provide a third drive current having a level based on the levels of the first and second input voltages on a condition that both the levels of the first and second input currents are greater than zero.

3. The circuit of claim 1, further comprising a circuit board comprising the first input terminal and the second input terminal and on which the first current generator, the second current generator, and the controller are disposed.

4. The system of claim 2, further comprising:

a first circuit board on which at least the first, second, and third LED arrays are disposed; and a second circuit board on which the converter circuit is disposed.

5. The circuit of claim 1, wherein the first current generator comprises at least:

a first circuit electrically coupled to receive a first input voltage based on the first input current and provide a first output voltage based on the first input voltage; and a first voltage controlled current source electrically coupled to receive the first output voltage and provide the first drive current based on a level of the first output voltage.

6. The circuit of claim 5, wherein the second current generator comprises at least:

a second circuit electrically coupled to receive a second input voltage based on the second input current and provide a second output voltage based on the second input voltage; and a second voltage controlled current source electrically coupled to receive the second output voltage and provide the second drive current based on a level of the second output voltage.

7. The circuit of claim 6, wherein the controller is configured to provide the third drive current having a level based on the levels of the first and second input voltages on a condition that both the levels of the first and second input currents are greater than zero.

8. The device of claim 1, wherein the control circuit comprises a switch and gate control logic, the gate control logic configured to turn the switch on in response to the condition that both the levels of the first and second input currents are greater than zero and to turn the switch off otherwise.

9. The system of claim 2, wherein the first CCT corresponds to warm white light, the second CCT corresponds to cool white light, and the third CCT corresponds to neutral white light.

10. The system of claim 2, wherein the first, second, and third drive currents adjust a brightness of a light output of a respective one of the first, second, and third LED arrays to control a composite light output of the system over a tunability range between 2700K and 6500K.

11. The device of claim 2, wherein the first computational circuit comprises:

a first divided resistor configured to attenuate the first input voltage;

a first low pass filter configured to filter the attenuated first input voltage; and a first operational amplifier.

12. The device of claim 2, wherein the second computational circuit comprises:

a second divided resistor configured to attenuate the first input voltage;

a second low pass filter configured to filter the attenuated first input voltage; and a second operational amplifier.

13. The device of claim 2, wherein the first computational circuit is configured to decrease the first output voltage to approximately zero on a condition that a difference between the first input voltage and the second input voltage is negative.

14. The device of claim 2, wherein the second computational circuit is configured to decrease the second output voltage to approximately zero on a condition that a difference between the second input voltage and the first input voltage is negative.

15. A device comprising:

a two-channel LED driver having two output terminals configured to provide a separate driving current at each of the two output terminals; and a converter circuit having two input terminals, each of the two input terminals electrically coupled to a respective one of the two output terminals of the two-channel LED driver, and three output terminals, each of the three output terminals configured to provide a separate LED drive current, a first of the two input terminals of the converter circuit is configured to receive a first current having a first current level from a first one of the two output terminals of the two-channel LED driver, and a second of the two input terminals of the converter is configured to receive a second current having a second current level from a second one of the two output terminals of the two-channel LED driver, the converter circuit further including:

a first current generator configured to provide a first drive current having a level equal to the first current level minus the second current level on a condition that the first current level is greater than the second current level and equal to zero otherwise, a second current generator configured to provide a second drive current having a level equal to two times the second current level on a condition that the first current level is greater than the second current level and equal to two times the first current level otherwise, and a controller configured to provide a third drive current having a level equal to zero on a condition that the first current level is greater than the second current level and equal to the second current level minus the first current level otherwise.

16. The device of claim 15, further comprising a circuit board comprising the first input terminal and the second input terminal and on which the first current generator, the second current generator, and the controller are disposed.

17. The device of claim 15, wherein the converter circuit comprises:

a first computational circuit electrically coupled to receive a first voltage based on a first driving current of the two channel driver and configured to provide a first output voltage having a level equal to a level of the second input voltage minus a level of the first input voltage;

a second computational circuit electrically coupled to receive a second input voltage based on a second driving current of the two channel driver and configured to provide a second output voltage having a level equal to the level of the first input voltage minus the level of the second input voltage;

a first current generator configured to generate a first drive current having a level based on the level of the first output voltage;

a second current generator configured to generate a second drive current having a level based on the level of the second output voltage; and a control circuit configured to provide a third drive current having a level based on the levels of the first and second input voltages on a condition that both the levels of the first and second input currents are greater than zero.

* * * * *